United States Patent [19]

Kanno et al.

[11] 4,285,510

[45] Aug. 25, 1981

[54] SHEET FEEDING CASSETTE FOR COPYING APPARATUS CAPABLE OF RECEIVING MANUALLY INSERTED SHEETS

[75] Inventors: Tadaaki Kanno, Yokosuka; Tadao Koike, Tokyo, both of Japan

[73] Assignee: Ricoh Co. Ltd., Japan

[21] Appl. No.: 90,280

[22] Filed: Nov. 1, 1979

[30] Foreign Application Priority Data

Nov. 13, 1978 [JP] Japan ..... 53/155975[U]

[51] Int. Cl.[3] ..... B65H 1/08

[52] U.S. Cl. ..... 271/127; 271/164; 271/9

[58] Field of Search ..... 271/9, 126, 127, 162, 271/164

[56] References Cited

U.S. PATENT DOCUMENTS

| | | | |
|---|---|---|---|
| 3,689,064 | 9/1972 | Kuksa | 271/164 |
| 3,977,666 | 8/1976 | Suzuki | 271/127 X |
| 4,017,181 | 4/1977 | Komaba | 271/162 X |
| 4,023,792 | 5/1977 | Punnett | 271/127 X |
| 4,083,553 | 4/1978 | Beck | 271/164 X |

*Primary Examiner*—Richard A. Schacher

*Attorney, Agent, or Firm*—McGlew and Tuttle

[57] ABSTRACT

A sheet feeding cassette which is capable of receiving manually inserted sheets is disclosed to eliminate the need to provide a copying apparatus with a device for receiving manually inserted sheets when the copying apparatus uses a sheet feeding cassette for sheet feeding. For readily receiving manually inserted sheets when the cassette is in position in the copying apparatus, the cassette includes a pressure plate responsive to the action of a sheet feeding pressure applying member, an upper lid capable of opening and closing even when the cassette is in position in the copying apparatus, and a member operative to cause the sheet feeding pressure applying member to act or stop its action in conjunction with the opening and closing of the upper lid. Sheets other than those which are usually contained in the cassette can be readily and positively manually fed readily and positively to the copying apparatus as desired for the purpose of producing copies.

7 Claims, 4 Drawing Figures

SHEET FEEDING CASSETTE FOR COPYING APPARATUS CAPABLE OF RECEIVING MANUALLY INSERTED SHEETS

FIELD AND BACKGROUND OF THE INVENTION

This invention relates to a sheet feeding cassette which is capable of receiving manually inserted sheets for loading a copying apparatus with sheets for producing duplicates or copies.

The use of a cassette containing sheets suitable for producing copies by a copying apparatus has the effects of saving the trouble of feeding sheets to the copying apparatus each time a copying operation is performed and of avoiding the occurrence of sheet jam or other accidents during a copying operation. The use of a sheet feeding cassette however, has the disadvantage that, as the need arises to use sheets of a type different from those usually contained in the cassette to meet the demand to provide copies of specific nature, it is necessary to remove the cassette from the copying apparatus, open its cover, replace the contained sheets with sheets of the desired type and load the cassette again into the copying apparatus each time the aforesaid need arises. To avoid this trouble, a copying apparatus is available which is formed separately with a sheet feeding opening and a sheet feeding table used exclusively for manually feeding sheets to the copying apparatus. This type of copying apparatus is disclosed, for example, in Japanese Laidopen Utility Model Application No. 50-40244 wherein the sheet feed roller is moved away from contact with the sheets in the cassette and brought into pressing engagement with a manual sheet feed roller in another position through a linkage, as the manual sheet feeding table is brought to an operative position when it is desired to effect manual sheet feeding, so that manual sheet feeding can be carried out by these two rollers. This type of copying apparatus is convenient but has the disadvantages that the mechanism is complex because two sets of sheet feeding mechanisms should be provided, the apparatus becomes large in size as a whole and the cost is increased.

SUMMARY OF THE INVENTION

This invention obviates the aforesaid disadvantages of the prior art. Accordingly, the invention has, as one of its object, the provision of a sheet feeding cassette for use with a copying apparatus which is capable of receiving manually inserted sheets and of feeding these sheets to the copying apparatus to eliminate the need to provide the copying apparatus with a sheet feeding opening and a sheet feeding table used exclusively for effecting manual sheet feeding.

The aforesaid object can be accomplished by providing the sheet feeding cassette with a mechanism comprising a pressure plate responsive to the action of a sheet feeding pressure applying member, an upper lid capable of opening and closing even when the cassette is in position in the copying apparatus, and a lever which is movable downwardly in a pivotal movement in conjunction with the movement of the upper lid to an open position for pushing the sheet feeding pressure applying member downwardly, the lever being engageable at one part thereof with the sheet feeding pressure applying member.

A further object of the present invention it to provide a sheet feeding cassette arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
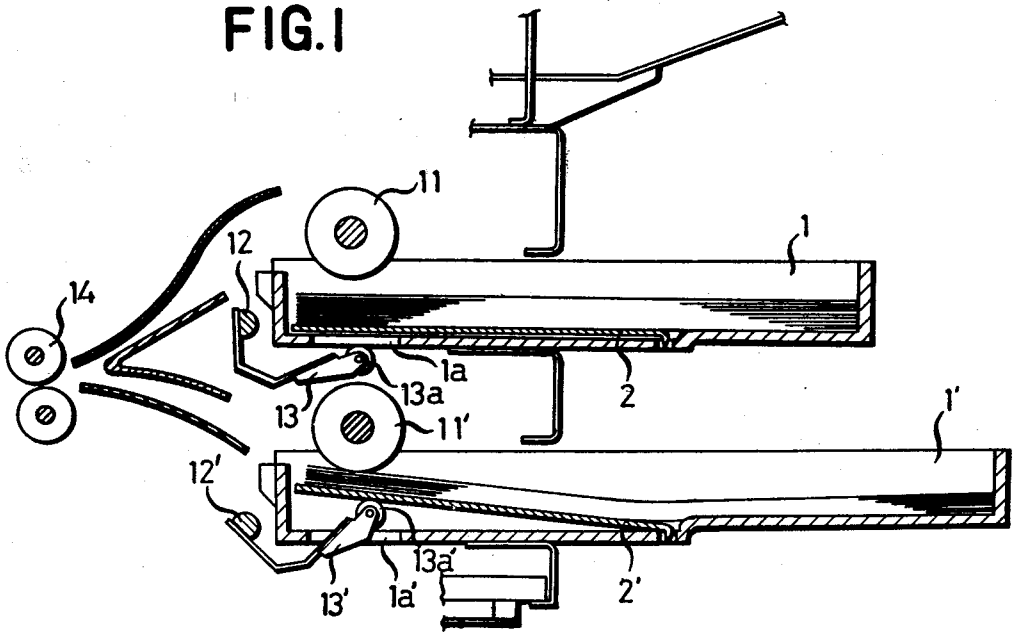
FIG. 1 is a sectional view of the sheet feeding section of a copying apparatus of the prior art wherein a sheet feeding cassette is used for supplying sheets to the copying apparatus.

When sheets are fed to a copying apparatus by using a sheet feeding cassette placed in position in the copying apparatus, it is usual practice to load two cassettes 1 and 1' in position in the copying apparatus which contain copying sheets of different sizes as shown in FIG. 1. The copying apparatus includes sheet feed rollers 11 and 11' each in contact with the uppermost sheet of one of two stacks of copy sheets in the cassettes 1 and 1' respectively, to frictionally feed one copy sheet after another to a copying position in the apparatus. The cassettes 1 and 1' are each provided at the bottom with a movable pressure plate 2 and 2', and a roller 13*a* and 13*a'* supported at the forward end of each of the pressure applying levers 13 and 13'. Levers 13, 13' are secured to shafts 12 and 12' respectively which are connected to the copying apparatus and extend through each of the openings 1*a* and 1*a'* formed at the bottom of the cassettes 1 and 1' respectively. Rollers 13*a*, 13*a'* are in contact with the undersurface of each of the pressure plates 2 and 2' respectively. A pair of register rollers 14 for feeding sheets in timed relation to the movement of a photosensitive member, not shown, is located within the copying apparatus and in front of the cassettes 1 and 1'. Stacks of sheets are each placed on one of the pressure plates 2 2'. When the pressure applying lever 13 or 13' acts on the undersurface of the pressure plate 2 or 2', the uppermost sheet of the stack of sheets is pressed by the sheet feed roller 11 or 11' to apply a sheet feeding pressure to the copy sheet and sheet feed roller. In FIG. 1, the pressure applying lever 13' is shown as acting on the undersurface of the pressure plate 2' of the lower cassette 1' and the pressure applying lever 13 of the upper cassette 1 is inoperative, so that sheet feeding is carried out from the lower cassette 1'. In another system known in the art for selectively feeding sheets from one of two cassettes, the sheet feed rollers 11 and 11' are selectively operated while the pressure applying levers 13 and 13' are both caused to act on the undersurfaces of the pressure plates 2 and 2'. It is to be understood that the sheet feeding cassette according to the invention presently to be described in detail can have application in a copying apparatus provided with one of the two systems for selectively feeding copy sheets described hereinabove.

Figure 2:
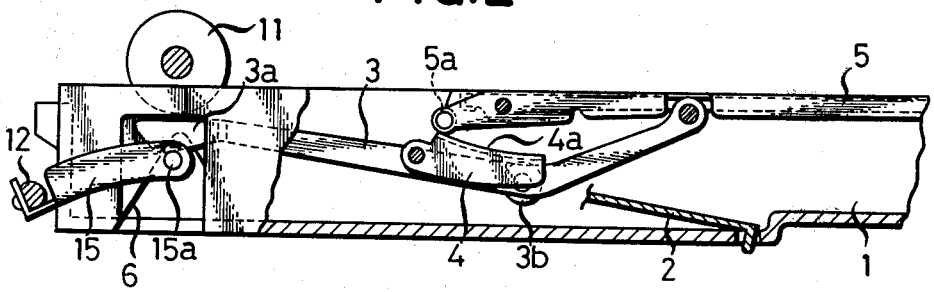
FIGS. 2 and 3 are side views partly is section of the cassette comprising one embodiment of the invention with a side wall removed, FIG. 2 showing the cassette performing a normal sheet feeding operation and FIG. 3 showing the cassette being engaged in manual sheet feeding position in the copying apparatus.
Figure 3:
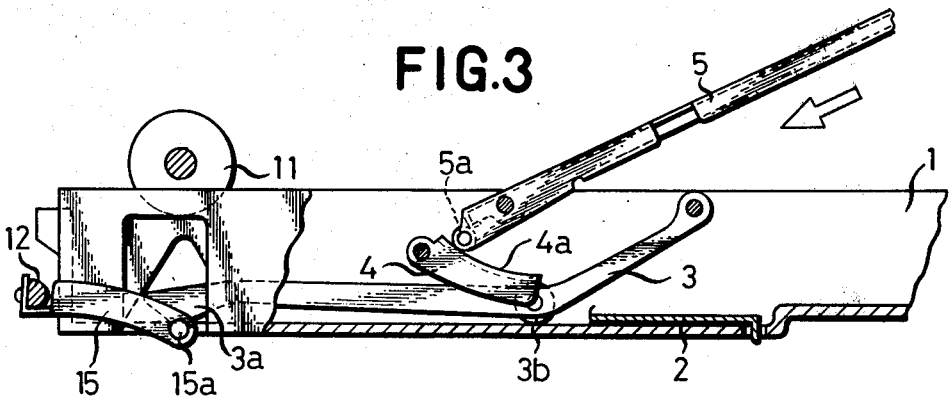
Figure 4:
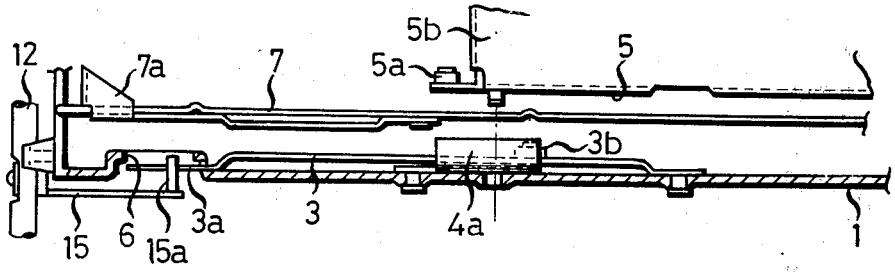
FIG. 4 is a partial top plan view of the cassette shown in FIGS. 2 and 3, showing the essential portions at one side of the cassette with the upper lid being slightly displaced from the side wall.

One embodiment of the invention will now be described with reference to FIGS. 2, 3 and 4. As shown, a pressure release lever 15 is connected to the shaft 12 supporting the pressure applying lever 13 not shown in FIGS. 2, 3 and 4 but as described hereinabove. As the cassette 1 is loaded in position in the copying apparatus, a trigger, not shown, is actuated to push the pressure applying lever 13, 13' (FIG. 1) upwardly and at the same time to move the forward end of the pressure release lever 15 upwardly. A push-down lever 3 in engagement with a pin 15*a* at the forward end of the pressure release lever 15, is pivotally supported by a side wall of the cassette 1 and includes an engaging portion 3*a* located at its forward end for engaging the pin 15*a* at the forward end of the pressure release lever 15, and a roller 3*b* located midway between the ends of the lever 3. An intermediary lever 4 in engagement with the roller 3*b* is L-shaped in cross section and pivotally supported by the side wall of the cassette 1 in a position immediately before the roller 3*b*. The intermediary lever 4 includes a face plate 4*a* having an upper surface on which acts a roller 5*a* at the forward end of an upper lid lever 5 presently to be described, and an undersurface which pushes downwardly on the roller 3*b* of the pushdown lever 3. The upper lid lever 5 is unitary with an upper lid 5*b* of the cassette 1 and pivotally connected to the side wall of the cassette 1. By actuating or moving a rear part of the upper lid lever 5, it is possible to freely open or close the upper lid 5*b* even when the cassette 1 is in position in the copying apparatus. The upper lid lever 5 has connected to its forward end the roller 5*a* for pushing the upper surface of the face plate 4*a* of the intermediary lever 4 downwardly as described hereinabove. In the interest of clarity, the upper lid lever 5 is shown in FIG. 4 in a position in which it is removed and displaced from the side wall of the cassette 1. A triangular cutout is formed near the forward end of the side wall of the cassette 1 to serve as the guide surface 6 for a pin 15*a* at the forward end of the pressure release lever 15. As the cassette 1 is unloaded from the copying apparatus, the guide surface 6 moves the pin 15*a* downwardly at the forward end of the pressure release lever 15, to lock the pressure applying lever 13 (FIG. 1) in a position remote from the path of movement of the cassette 1. A side fence 7 for guiding the lateral surface of the sheets is connected to the inner side of the side wall of the cassette 1 and has at its forward end a corner claw 7*a*.

In operation, as the cassette 1 is loaded in the copying apparatus, the pressure applying lever 13 of the copying machine is moved from a locked position to a pressure applying position and pivotally moves counter clockwise about the shaft 12 (FIG. 1). This moves the pressure releasing lever 15 (FIG. 2) in the same direction, so that the pin 15*a* at the forward end of the lever 15 pushes the forward end 3*a* of the push-down lever 3 upwardly into a position shown in FIG. 2. The roller 13*a* at the forward end of the pressure applying lever 13 pushes the pressure plate 2 upwardly to bring the uppermost sheet of the stack of sheets on the pressure plate 2 into pressing engagement with the sheet feed roller 11. In this condition, one sheet after another is fed from the stack of sheets in the cassette 1 to the copying position to produce copies. At this time, the upper lid 5*b* is, of course, in a closed position and the roller 5*a* at the forward end of the upper lid lever 5 is away from the face plate 4*a* of the intermediary lever 4.

When it is desired to effect copying on sheets other than those usually contained in the cassette 1 or on the undersurfaces of the sheets which have been printed with duplicates on the upper surfaces, the upper lid lever 5 is lifted to bring the upper lid 5*b* to an open position. This brings the roller 5*a* at the forward end of the lever 5 into engagement with the face plate 4*a* of the intermediary lever 4 so that the face plate 4*a* is forced to move downwardly. This moves the intermediary lever 4 clockwise in pivotal movement to push the roller 3*b* of the push-down lever 3 downwardly, which in turn, at the engaging portion 3*a* at its forward end, pushes the pin 15*a* downwardly at the forward end of the pressure release lever 15 and into a position shown in FIG. 3. At the same time, the pressure applying lever 13 is also pushed downwardly, and the pressure plate 2, under the influence of the pressure applying lever 13, moves downwardly to form a gas between the uppermost sheet of the stack of sheets in the cassette 1 and the sheet feed roller 11. This allows the desired sheets to be inserted manually in the direction indicated by an arrow in FIG. 3, into the cassette 1. After insertion of the desired sheets is finished, the upper lid 5*b* is brought to its closed position again as shown in FIG. 2. In this condition, the desired sheets can be fed to the copying position to carry out the production of copies on the desired sheets.

The angle formed by the upper lid 5*b* in its open position and the upper surface of the cassette 1 varies depending on the size of the sheets. Thus it is essential to select the position and shape of each lever in such a manner that the pressure plate 2 is disposed at the lowermost level when the upper lid forming the smallest angle in its open position is in the full open position. When the upper lid 5*b* forms the largest angle in its open position, it is essential to form a portion of the upper surface of the face plat 4*a* of the intermediary lever 4 as an arcuate surface centered at the pivot of the upper lid lever 5 to avoid displacement of the intermediary lever 4 as the upper lid lever 5 moves in pivotal movement, to thereby avoid any trouble that might otherwise be caused by the movement of the upper lid 5*b* to its full open position.

From the foregoing description, it will be appreciated that, according to the present invention, opening of the upper lid necessary for insertion of sheets in the cassette is coupled to release of the pressure applied to the sheets in the cassette for feeding the sheets to the copying position, so that opening of the upper lid and insertion of the sheets can be performed in a single operation. By bringing the upper lid to a closed position following completion of insertion of the sheets in the cassette, the sheets inserted in the cassette can readily be fed to the copying position. Thus the operator can open and close the upper lid with one hand while inserting the sheets with the other hand. This enables manual insertion of sheets of the type different from those contained in the cassette to be effected readily when the cassette is in position in the copying apparatus, even by an operator who is not skilled in the handling of the cassette and copying apparatus. Thus the invention increases the scope of use of the copying machine. Moreover, since the invention enables manual insertion of sheets to be readily effected merely by incorporating an improvement in the construction of the cassette, not by changing the design of the copying apparatus, the invention can achieve excellent results in the utilization of copying apparatus of the prior art.

While a specific embodiment of the invention has been shown and described in detail to illustrate the application of the principles of the invention, it will be understood that the invention may be embodied otherwise with departing from such principles.

What is claimed is:

1. A sheet feeding cassette of a copying apparatus for supporting a stack of sheets, which is capable of receiving manually inserted sheets and which has a sheet feeding pressure applying member connected thereto, comprising:

a pressure plate responsive to the action of the sheet feeding pressure applying member of the copying apparatus, connected to the cassette;

an upper lid pivotally connected to the cassette capable of moving to an open position or a closed position even when the cassette is in position in the copying apparatus; and a push-down lever connected to the cassette maintained in engagement with the sheet feeding pressure applying member and movable in conjunction with the movement of said upper lid to an open position in such a manner as to move the sheet feeding pressure applying member away from said pressure plate;

the upper lid being pivotally supported by side walls of the cassette and the push-down lever being moved by means of an intermediary level connected to the cassette moved by the pushing down of a portion of the upper lid in conjunction with the opening movement of said upper lid, whereby the sheet feeding pressure applying member is moved away from said pressure plate;

the intermediary level being located between the upper lid portion and the push-down lever and having an arcuate surface centered at the pivotal support of the upper lid.

2. In a copying apparatus having at least one cassette in position for carrying a stack of sheets, a feed roller for feeding one sheet at a time from the cassette in position in the copying apparatus and a pressure applying lever movable into a position for bringing the stack into engagement with the feed roller, an improvement comprising, cassette lid means movably mounted to the cassette and engageable with the pressure applying lever to move the pressure applying lever out of its position for bringing the stack into engagement with the feed roller, said cassette lid means having an upper lid pivotally mounted to the cassette so that a rear part of the lid can be moved into an open position for bringing the stack out of engagement with the feed roller when the cassette is in position in the copying apparatus, whereby a manually inserted sheet can be inserted into the cassette at the top of the stack.

3. An improvement according to claim 11, including, an intermediary lever pivotally mounted to the cassette and engaged with one end of the upper lid, a push-down lever pivotally mounted to the cassette and engaged with the intermediary lever and a pressure release lever connected to the pressure applying lever engaged with the push-down lever.

4. An improvement according to claim 3, wherein said intermediary lever has an upper curved surface engaged by said end of said upper lid having a center of curvature substantially at a pivotal mounting point for said upper lid to the cassette.

5. An improvement according to claim 3, wherein the cassette has a guide surface engageable with said pressure release lever for moving said pressure release lever into a position to cause the pressure applying lever to move out of its position for bringing the stack into engagement with the feed roller.

6. An improvement according to claim 5 further including a pressure plate pivotally mounted to the cassette for receiving at least a portion of the stack of sheets and engageable by the pressure applying lever for bringing the stack of sheets into engagement with the feed roller.

7. An improvement according to claim 6, further including a rotatable shaft mounted in the copying apparatus connected to the pressure applying lever and to said pressure release lever.

* * * * *